US006675968B2

(12) United States Patent
Craig et al.

(10) Patent No.: US 6,675,968 B2
(45) Date of Patent: Jan. 13, 2004

(54) APPARATUS FOR SHIPPING PREFORMED FLOWER POT COVERS

(75) Inventors: Frank J. Craig, Valey Park, MS (US); Sergio Cerda Garcia, Harlingen, TX (US); Glen M. Burdick, Minco, OK (US)

(73) Assignee: Southpac Trust International, Inc., Highland, IL (US)

( * ) Notice: Subject to any disclaimer, the term of this patent is extended or adjusted under 35 U.S.C. 154(b) by 0 days.

(21) Appl. No.: 10/131,722

(22) Filed: Apr. 23, 2002

(65) Prior Publication Data

US 2002/0121452 A1 Sep. 5, 2002

Related U.S. Application Data

(63) Continuation of application No. 09/651,500, filed on Aug. 30, 2000, now Pat. No. 6,405,871.

(51) Int. Cl.[7] ..... B65D 85/50
(52) U.S. Cl. ..... 206/423; 206/499; 53/447
(58) Field of Search ..... 206/499, 423, 206/515–519; 53/399, 447, 443, 445

(56) References Cited

U.S. PATENT DOCUMENTS

| | | | | |
|---|---|---|---|---|
| 1,280,692 A | | 10/1918 | Errett | |
| 1,398,030 A | | 11/1921 | Luellen | |
| 1,405,825 A | * | 2/1922 | Flannery | 206/499 |
| 3,759,303 A | | 9/1973 | Honrichs et al. | |
| 3,804,234 A | | 4/1974 | Gordon | |
| 4,033,455 A | | 7/1977 | Robison | |
| 4,170,294 A | | 10/1979 | Zelinski | |
| 4,227,362 A | | 10/1980 | Wallsten | |
| 4,592,840 A | * | 6/1986 | Brooks | 210/493.5 |
| 5,092,464 A | | 3/1992 | Taylor | |
| 5,128,157 A | | 7/1992 | Ruiz | |
| 5,472,752 A | | 12/1995 | Weder et al. | |
| 5,551,563 A | | 9/1996 | Allen | |
| 5,615,767 A | * | 4/1997 | Eull et al. | 206/278 |
| 5,881,877 A | * | 3/1999 | Adams | 206/373 |
| 6,122,896 A | | 9/2000 | Weder et al. | |
| 6,405,871 B1 | * | 6/2002 | Craig et al. | 206/499 |

* cited by examiner

*Primary Examiner*—Shian Luong
(74) *Attorney, Agent, or Firm*—Dunlap, Codding & Rogers P.C.

(57) ABSTRACT

An apparatus and method for shipping a plurality of preformed flower pot covers is provided. Each preformed flower pot cover including a base formed into a shape sized to receive a flower pot. The preformed flower pot cover having a closed lower end and an open upper end with an object opening extending therethrough for receiving the flower pot. The apparatus includes a container provided with a top, a bottom, and a plurality of sidewalls cooperating to define an inner packing compartment. Each of the top, bottom and sidewalls have an interior surface and an exterior surface. The apparatus includes at least a first stacking shell configured to receive the base of the preformed flower pot cover. The first stacking shell extending from the interior surface of the bottom of the container. The apparatus further includes at least a second stacking shell configured to be received in the object opening of the preformed flower pot cover. The second stacking shell extending from the interior surface of the top of the container.

6 Claims, 5 Drawing Sheets

APPARATUS FOR SHIPPING PREFORMED FLOWER POT COVERS

This application is a continuation of U.S. Ser. No. 09/651,500, filed Aug. 30, 2000, now U.S. Pat. No. 6,405,871.

Not applicable.

BACKGROUND OF THE INVENTION

1. Field of the Invention

The present invention relates generally to the shipping of articles in a container, and more particularly, but not by way of limitation, to an improved apparatus and method of shipping and transporting preformed flower pot covers.

2. Brief Description of the Related Art

Decorative covers for flower pots have been used for many years to accentuate or complement the aesthetic appearance of a floral grouping disposed in the flower pot. Such decorative covers are often preformed flower pot covers made by forming a flexible sheet of material into a shape adapted to receive the flower pot.

In the process of forming the sheet of material into the flower pot cover, a plurality of overlapping folds are formed in the material. The overlapping folds cooperate to form a base portion which provides structural strength to keep the preformed shape of the flower pot cover. In addition, flower pot covers are often formed to have a skirt portion which is designed to extend beyond the upper end of the flower pot and functions to cover the soil and the lower portion or stem portion of a floral grouping which can be unattractive and thus draw away from the attractiveness of the combination of the blooms of the floral grouping and the flower pot cover.

To ship flower pot covers after the forming process, a plurality of the preformed flower pot covers are typically stacked or nested relative to one another and the stack is placed in a cardboard box which is then closed and sealed. While the use of cardboard boxes have been widely accepted in the packaging and shipping of preformed flower pot covers, they are not without disadvantages.

For reasons of economy and efficiency, a large number of flower pot covers are stacked together and placed in a container for shipping. However, the base portion of the flower pot covers near the bottom of the stack become stretched and deformed from the weight of the remainder of the stack. The deformed flower pot covers are unattractive and do not properly form about the flower pot.

Also, shipping containers are frequently subjected to abuse during transport which disrupts the contents. When the stack of flower pot covers within the container shifts about the interior of the container, the skirt portion of the flower pot covers become matted and deformed while resting against one side of the shipping container. Flower pot covers with a deformed base and skirt are either repaired or discarded.

To this end, an apparatus and method of packaging preformed flower pot covers is needed that permits easy transport of a large quantity of flower pot covers while overcoming the disadvantages mentioned above. It is to such an apparatus and method that the present invention is directed.

BRIEF SUMMARY OF THE INVENTION

The present invention is directed to an apparatus and method for shipping a plurality of preformed flower pot covers. Each preformed flower pot cover includes a base formed into a shape sized to receive a flower pot. The preformed flower pot cover includes the base having an opened upper end, a closed lower end, an object opening extending through the upper end, and a decorative skirt which extends angularly upwardly and outwardly from the upper end of the base. The apparatus includes a container provided with a top, a bottom, and a plurality of sidewalls cooperating to define an inner packing compartment. The apparatus includes at least a first stacking shell configured to receive the base of the preformed flower pot cover. The first stacking shell is disposed within the inner packing compartment and extends from the bottom of the container upwardly into the inner packing compartment. Additionally, the apparatus may further include a second stacking shell configured to be received in the object opening of the base of the preformed flower pot cover. The second stacking shell is disposed within the inner packing compartment and extends from the top of the container.

The features and advantages of the present invention will become apparent from the following detailed description when read in conjunction with the accompanying drawings and appended claims.

DETAILED DESCRIPTION OF THE INVENTION

The present invention is generally directed to an apparatus for packaging a plurality of preformed flower pot covers formed from a flexible sheet of material. The sheet of material used to form the flower pot covers is typically fabricated from a polymeric material selected from a group consisting of polypropylene, polyvinyl chloride, combinations thereof, or laminates of such polymeric materials. However, it will be appreciated that the sheet of material can be fabricated of paper, metal foil, cloth, denim, burlap, or laminates of such materials including laminates of one or more of such materials and polymeric materials, such as a laminate of paper and a polymeric material or metal foil and a polymeric metal. The sheet of material contemplated to be used with the present invention is also relatively thin having a thickness in a range from about 0.5 mil to about 30 mils, and the sheet of material is very flexible and flimsy so that the sheet of material will not normally maintain or hold a predetermined formed shape.

Figure 1:
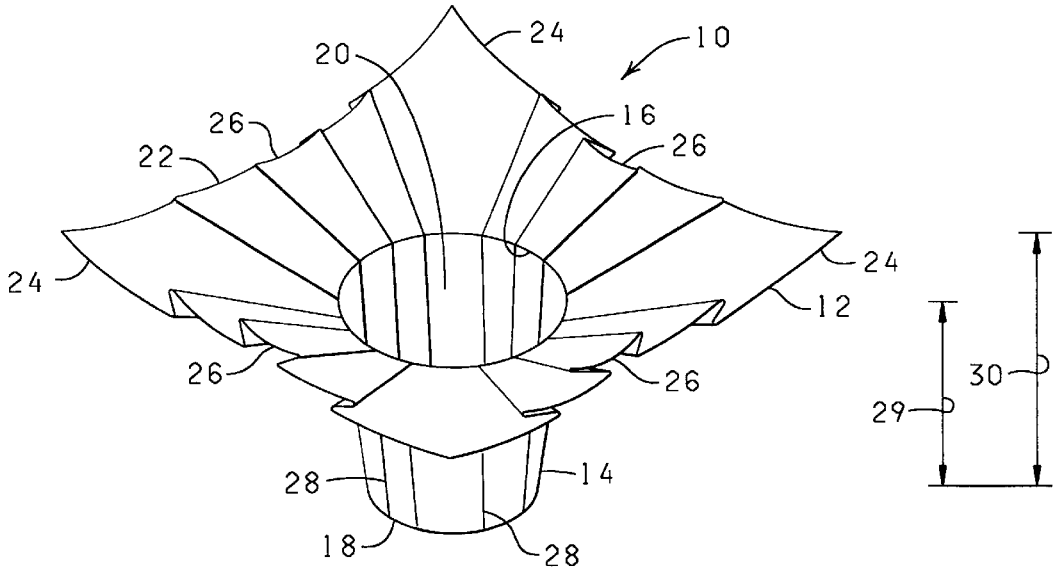
FIG. 1 PRIOR ART
FIG. 1 is a perspective view of a prior art preformed flower pot cover.

Referring now to FIG. 1, shown therein is a preformed flower pot cover 10 formed from a generally square-shaped sheet of material 12. It should be understood that the sheet of material may be of any shape, such as circular or other suitable configurations. The preformed flower pot cover 10 includes a base 14 having an opened upper end 16, a closed lower end 18, an object opening 20 extending through the upper end 16, and a decorative skirt 22 which extends angularly upwardly and outwardly from the upper end 16 of the base 14.

The decorative skirt 22 includes four accentuated and sculptured flared petal-like portions 24. Each flared petal-like portion 24 terminates with a pointed end which is formed by one of the four corners of the square-shaped sheet of material 12. Further, each flared petal-like portion 24 extends a distance angularly upwardly and outwardly from the open upper end 16 of the base 14 terminating with the pointed end of the flared petal-like portion 24. The flared petal-like portions 24 are spaced apart circumferentially about the decorative skirt 22 with the flared petal-like portions 24 being spaced apart at about ninety degree intervals, and a flare connecting portion 26 disposed between each pair of adjacent flared petal-like portions 24. Each of the flare connecting portions 26 extends a distance angularly upwardly and outwardly from the open upper end 16 of the base 14 less than the distances which the pointed ends of the flared petal-like portions 24 extend from the open upper end 16 of the base 14.

The object opening 20 of the preformed flower pot cover 10 is shaped and sized to receive a flower pot (not shown). When a flower pot is disposed in the object opening 20 of the preformed flower pot cover 10, the base 14 substantially encompasses the outer peripheral surface of the flower pot extending generally between the open upper and the closed lower ends of the flower pot with the upper end 16 of the base 14 being disposed generally near the upper end of the flower pot and the closed lower end 18 of the preformed flower pot cover 10 being disposed generally near the lower end of the flower pot. The closed lower end 18 of the preformed flower pot cover 10 extends across and encompasses the lower end of the flower pot. When the preformed flower pot cover 10 is disposed about the flower pot, the decorative skirt 22 of the preformed flower pot cover 10 extends a distance angularly upwardly and outwardly from the upper end of the flower pot and the preformed flower pot cover 10 extends generally circumferentially about the all upper end of the flower pot.

The base 14 of the preformed flower pot cover 10 includes a plurality of overlapping folds 28. A substantial portion of the overlapping folds 28 extend at angles to a vertical direction and at angles to a horizontal direction, the various angles being arbitrary and varying from one overlapping fold 28 to another overlapping fold 28. Further, the base 14 includes a plurality of overlapping folds 28 with the various overlapping folds 28 being positioned at various positions about the entire outer peripheral surface of the base 14 and at various positions between the upper and the lower ends 16 and 18 of the base 14.

The overlapping folds 28 provide an overall decorative appearance to the base 14. However, more significantly, the overlapping folds 28 provide a mechanical strength to the base 14 for enabling the base 14 to stand upright on the closed lower end 18 of the base 14. In this manner, the base 14 of the preformed flower pot cover 10 has sufficient mechanical strength to stand upright about a flower pot without the necessity of mechanically connecting the base 14 to a flower pot, other than the connection normally provided when the lower end of a flower pot engages the closed lower end 18 of the preformed flower pot cover 10 when the preformed flower pot cover 10 is disposed about a flower pot. The base 14 has a height 29 extending from the closed lower end 18 to the open upper end 16 of the base 14 of the preformed flower pot cover 10. The preformed flower pot cover 10 has an overall height 30 from the closed lower end 18 of the base 14 extending to the upward most portion of the decorative skirt 22.

The sheet of material 12 from which the preformed flower pot cover 10 is constructed is provided with a bonding material so that at least a portion of the overlapping folds 28 of the base 14 of the preformed flower pot cover 10 are bondingly connected so as to provide the desired structural strength to the base 14 of the preformed flower pot cover 10. A method and apparatus for producing the preformed flower pot cover 10 is disclosed in U.S. Pat. No. 5,029,412, issued to Weder et al. on Jul. 9, 1991, and U.S. Pat. No. 5,254,072, issued to Weder et al. on Oct. 19, 1993, both of which are hereby expressly incorporated herein by reference.

For aesthetic purposes, it is preferable that the decorative skirt 22 and particularly the flared petal-like portions 24 remain substantially free of bonded overlapping folds. Also, it is desirable that the flare connecting portions 26 also remain substantially free of bonded overlapping folds.

Figure 2:
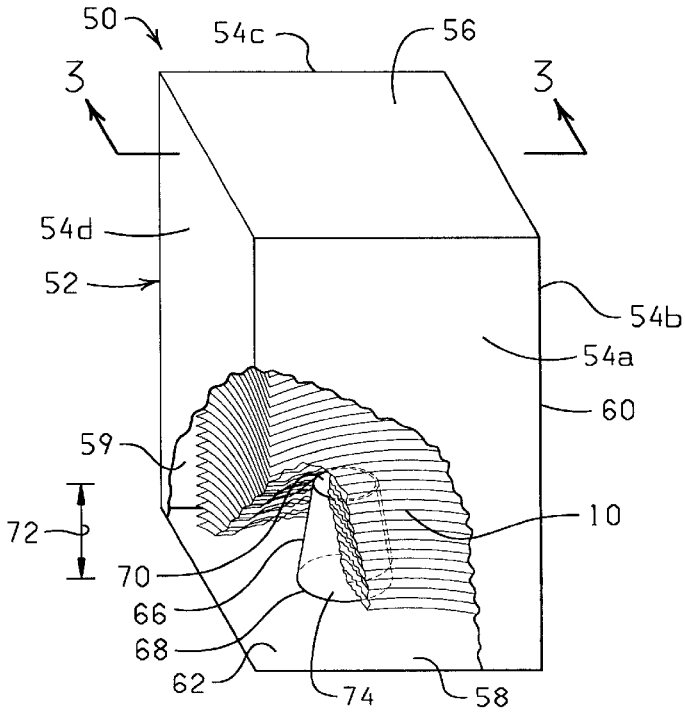
FIG. 2 is a partially cutaway perspective view of a shipping apparatus constructed in accordance with the present invention for use in transporting a plurality of preformed flower pot covers.

Referring now to FIG. 2, a shipping apparatus 50 for shipping a plurality of preformed flower pot covers 10 constructed in accordance with the present invention is illustrated. The shipping apparatus 50 provides a simple and low cost device for packaging and shipping a plurality of preformed flower pot covers 10 in a convenient and cost effective manner. The shipping apparatus 50 comprises a container 52 which has a plurality of sidewalls 54 which have been designated alphanumerically, for the sake of clarity, as the sidewalls 54*a*, 54*b*, 54*c*, 54*d*. The container has a top 56 and a bottom 58. The plurality of sidewalls 54, the top 56 and bottom 58 cooperate to define an inner packing compartment 59. The container 52 may be a standard cardboard shipping box wherein the plurality of sidewalls 54 are constructed of a cardboard material which is substantially rigid and suitable for the demands of shipping. However, the container 52 may be a wooden crate, plastic carton or other substantially square or rectangularly formed device whereby the plurality of sidewalls 54 are formed from wood, plastic, or other suitable materials. Thus it can be seen that the sidewall 54*a* which is adjacent to the sidewall 54*b* is connected at a line 60 in a manner well known to shipping containers such as a fold in the cardboard material or attachment by fasteners or bonding materials of wood, plastic or other materials. The construction of shipping containers, such as the container 52, are well known, therefore, no further description of the shipping container 52 is believed necessary for one of ordinary skill in the art to understand the method of construction and use of the container 52 of the shipping apparatus 50 of the present invention.

The shipping apparatus 50 is further provided with a stacking shell 66 which is disposed on an interior surface 62 of the bottom 58 of the container 52. The stacking shell 66 extends upward from the interior surface 62 of the bottom 58 within the inner packing compartment 59 of the container 52. The stacking shell 66 is configured to be disposed in the object opening 20 of the preformed flower pot cover 10, described above, so that a stack of the preformed flower pot covers 10 may be stacked on the stacking shell 66 in an inverted position, as illustrated in FIG. 2.

The stacking shell 66 may be constructed of any suitable material and configured in any desirable shape provided it is capable of supporting a plurality of preformed flower pot covers 10. However, a preferable material is a light weight, durable plastic or cardboard and a preferable shape is frusto-conical whereby the preformed flower pot covers 10, which are typically formed to have a frusto-conical shape for receiving a frusto-conically shaped flower pot, substantially conform to at least the contour of an upper portion of the stacking shell 66. By way of example, the stacking shell 66 could alternatively be a flower pot or a cardboard tube or styrofoam form having the necessary size and configuration to support a stack of preformed flower pot covers.

As shown in FIG. 2, the stacking shell 66 has a bottom end 68, a top end 70, a height 72 extending from the bottom to the top end 68 and 70, and an interior base support member 74 extending between the bottom end 68 and the top end 70. To provide more stability, the stacking shell 66 may be secured to the interior surface 62 of the bottom 58 of the container 52 in any suitable manner, such as with a bonding material, i.e. an adhesive, a cohesive, double-sided tape, and combinations thereof.

In operation, a plurality of preformed flower pot covers 10 are provided nested one within another to form a stack of preformed flower pot covers 10. The object opening 20 of the lower most preformed flower pot cover 10 is disposed on the stacking shell 66 so as to provide support for and prevent crushing and damage to the decorative skirt 22 and base 14 of the preformed flower pot cover 10 and each of the remaining preformed flower pot cover 10 in the stack of preformed flower pot cover 10. Thereafter, the top end 70 of the container 52 is closed and sealed. The shipping apparatus 50 containing the stack of preformed flower pot covers 10 can then be transported to a predetermined destination.

Figure 3:
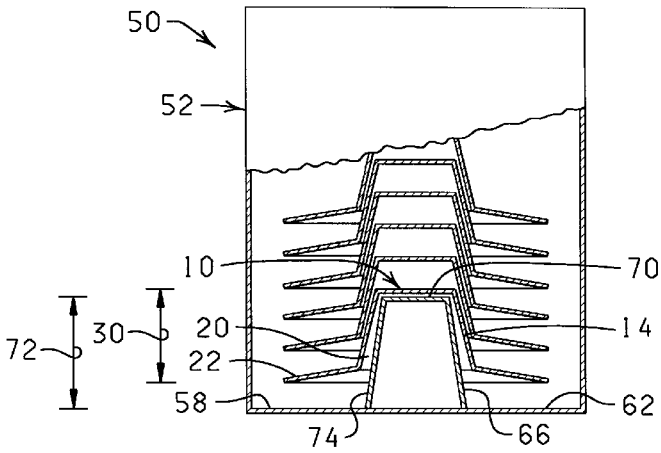
FIG. 3 is a partial cross-sectional view of the shipping apparatus of FIG. 2 taken along line 3—3 thereof.

Referring now to FIG. 3, a cross-sectional view of the shipping apparatus 50 of FIG. 2 taken along line 3—3 thereof is shown to more clearly illustrate the position of the preformed flower pot cover 10 on the stacking shell 66. The frusto-conical configuration of the stacking shell 66 for supporting the frusto-conically shaped base 14 of the preformed flower pot cover 10 can be more clearly seen. Additionally, the stacking shell 66 can be seen to be shaped and sized to be disposed in the object opening 20 of the preformed flower pot cover 10 while preventing contact of the decorative skirt 22 with the bottom 58 of the container 52 and thereby preventing damage to the decorative skirt 22 caused by contact with the interior surface 62 of the bottom 58 of the container 52. Thus it can be seen that the stacking shell 66 is configured to substantially conform to the shape of the object opening 20 of the base 14 of the preformed flower pot cover 10.

Upon providing a stack of preformed flower pot covers 10, the preformed flower pot covers 10 are supported on the stacking shell 66 so that the decorative skirt 22 of the preformed flower pot cover 10 is in a non-load bearing relationship with respect to the interior surface 62 of the bottom 58 of the container 52. To prevent damage to the decorative skirt 22 it is necessary for the height 72 of the stacking shell 66 to exceed in measurement the height 30 of the preformed flower pot cover 10. In this manner, the decorative skirt 22 of the preformed flower pot cover 10 maintains a position disposed substantially above the interior surface 62 of the bottom 58 and thus prevents damage to the decorative skirt 22 of the preformed flower pot cover 10.

Figure 4:
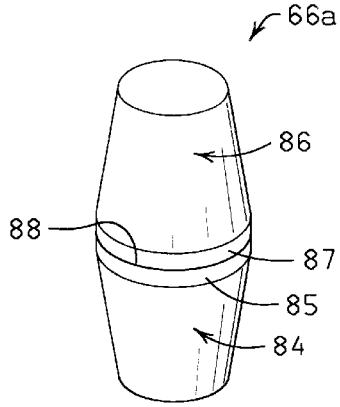
FIG. 4 is a perspective view of another embodiment of a stacking shell of the shipping apparatus constructed in accordance with the present invention.

Referring now to FIG. 4, a perspective view of another embodiment of a stacking shell **66*a* of the shipping apparatus 50 is shown. The stacking shell 66*a* may be formed from conventional flower pots. As such, the stacking shell 66*a* comprises a first flower pot 84 having an upper end 85 and a second flower pot 86 having a upper end 87. The first pot 84 is disposed in an upright position relative to the second pot 86 which is inverted such that an upper end 85 of the first flower pot 84 contactingly engages the upper end 87 of the second flower pot 86**.

In this manner, the first and second flower pots 84 and 86 may be attached at a point 88 of contact of the upper ends 85 and 87, respectively, with a bonding material such as an adhesive, a cohesive, single and double-sided tape or any other means suitable for connecting the first flower pot 84 to the second flower pot 86 in the manner depicted in FIG. 4. A cohesive or removable tape is preferable as that the first flower pot 84 may be readily detached from the second flower pot 86 after the shipping apparatus 50 has reached its destination and the preformed flower pot covers 10 have been removed therefrom.

The benefits of the configuration of the stacking shell **66*a* of FIG. 4 are numerous. For example, the receiver of the shipping apparatus 50 (see FIG. 2) provided with a plurality of preformed flower pot covers 10 may remove the stacking shell 66*a* from the container 52 and detach the first flower pot 84 from the second flower pot 86 and use the first and second flower pots 84 and 86 in a conventional manner in their floral operations. Also, this configuration reduces waste material by providing the stacking shell 66*a* that is valuable and readily reusable. While it has been shown that the first and second flower pots 84 and 86 are of similar size, it should be understood that they can be of varying sizes so long as the second flower pot 86 is disposable in the object opening 20 of the base 14 of the preformed flower pot cover 10**.

Figure 5:
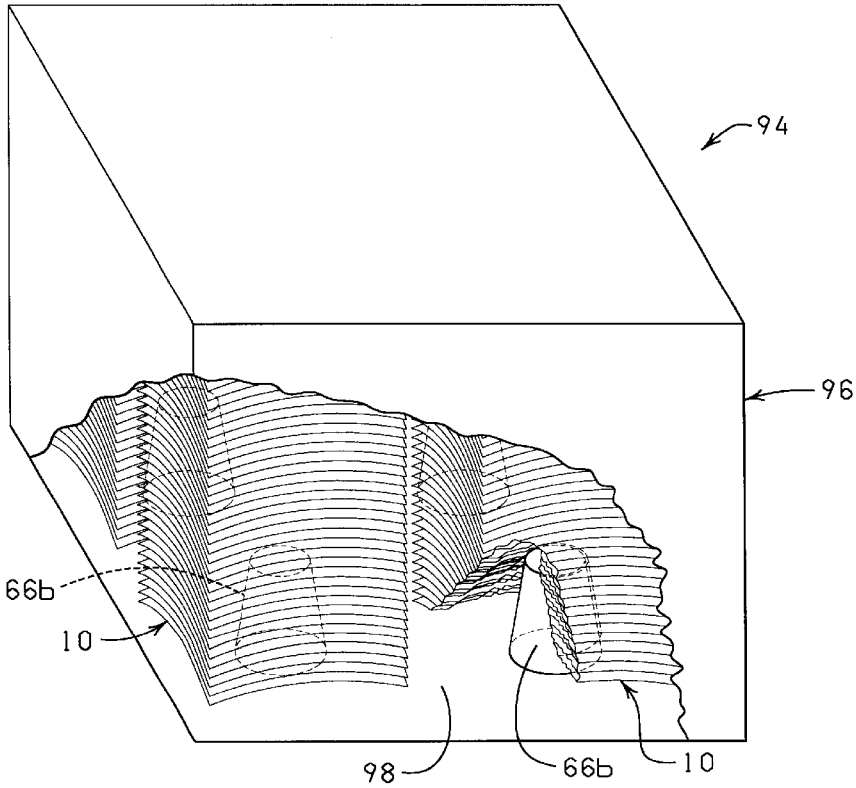
FIG. 5 is a partially cutaway perspective view of another embodiment of a shipping apparatus illustrating the use of a plurality of stacking shells with a plurality of stacks of preformed flower pot covers supported thereon.

Referring now to FIG. 5, a perspective view of another embodiment of a shipping apparatus 94 is illustrated using a plurality of stacking shells **66*b* each of which is adapted to receive a plurality of a preformed flower pot covers 10 supported thereon. The apparatus 94 includes a container 96 constructed substantially similar to the container 52 described above except that the container 96 is provided with a larger interior packing compartment 98 so that the plurality of stacking shells 66 are supported therein. The stacking shells 66*b* are substantially similar in construction to the stacking shell 66 herein before described with reference to FIGS. 2 and 3 except that the plurality of the stacking shells 66*b* are supported in the interior packing compartment 98 of the container 96. That is, the shipping apparatus 94 is depicted as containing four stacking shells 66*b* each supporting a stack of preformed flower pot covers 10 in less overall shipping space than four individual shipping apparatuses 50 (see FIG. 2) which is provided with only the single stacking shell 66. Although the shipping apparatus 94 is shown having four stacking shells 66 any number of stacking shells 66 may be provided to optimally suit the needs of the shipper so long as the shipping apparatus 94 is suitably sized to retain a greater number of stacking shells 66 and stacks of preformed flower pot covers 10**.

Figure 6:
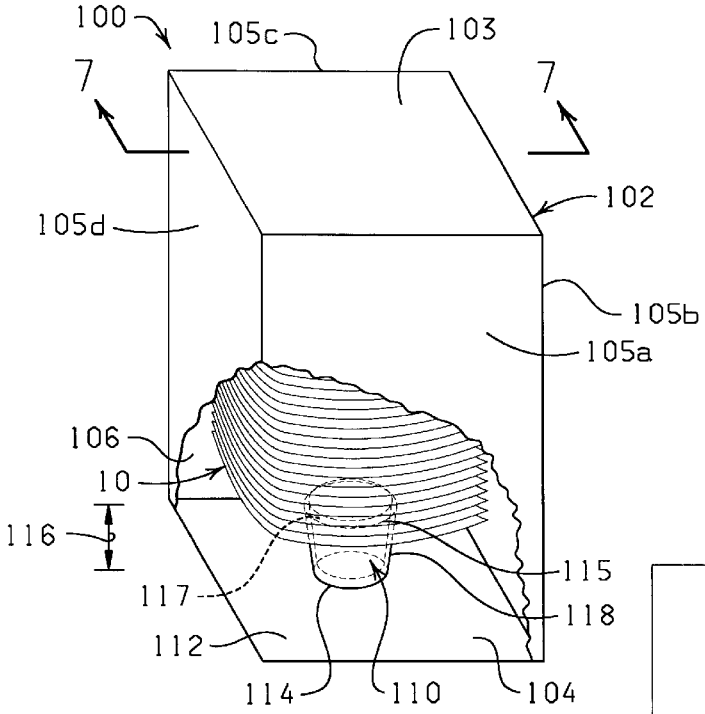
FIG. 6 is a partially cutaway perspective view of another embodiment of a shipping apparatus constructed in accordance with the present invention for use in transporting a plurality of preformed flower pot covers.

Referring now to FIG. 6, a perspective view of another embodiment of a shipping apparatus 100 is shown which is constructed in accordance with the present invention for use in transporting a plurality of preformed flower pot covers 10. The shipping apparatus 100 is provided with a container 102 which has a top 103, a bottom 104, and a plurality of sidewalls 105 which are substantially similar in construction and operation have been alphanumerically denoted 105*a*, 105*b*, 105*c*, and 105*d*, for the sake of clarity. The top 103, the bottom 104, and the plurality of sidewalls 105 cooperate to define an inner packing compartment 106 The container 102 is constructed substantially similar to the container 52 (shown in FIG. 2).

The shipping apparatus 100 is also provided with another embodiment of a stacking shell 110. The stacking shell 110 is disposed on an interior surface 112 of the bottom 104 of the container 102 and extends upwardly within the inner packing compartment 106 thereof. The stacking shell 110 is provided with a bottom end 114, a top end 115, and height 116 extending from the bottom end 114 to the top end 115. The stacking shell 110 is further provided with an exterior base support member 118 extending from the bottom end 114 to the top end 115, the exterior base support member 118, the bottom end 114 and the top end 115 defining an opening 117. The exterior base support member 118 being configured to supportingly receive the contours of the base 14 of the preformed flower pot cover 10 such that the decorative skirt 22 extends upwardly from the top end 115 of the stacking shell 110.

That is, upon providing a stack of preformed flower pot covers 10, a the base 14 of the preformed flower pot covers 10 are laterally supported in the opening 117 of the stacking shell 110 so as to prevent damage or distortion to the overlapping connecting folds 28 of the base 14 of the preformed flower pot covers 10 as well as the decorative skirt 22 of the preformed flower pot cover 10.

It will be appreciated that when a plurality of preformed flower pot covers 10 are nested relative to one another, the preformed flower pot covers 10 near the bottom of the stack are subjected to pressures from the weight of the preformed flower pot covers 10 higher in the stack. The effect of these pressures is to put lateral stress on the overlapping connecting folds 28 of the preformed flower pot covers 10. The lateral support provided by the stacking shell 110 prevents these detrimental effects on the preformed flower pot covers 10.

The stacking shell 110 is attached to the interior surface 112 of the bottom 104 of the container 102 by any means suitable such as using a bonding material, i.e. an adhesive material, a cohesive material, double-sided tape or other materials suitable for use as a bonding material. The bondable attachment secures the stacking shell 110 to the bottom 104 of the container 102.

Figure 7:
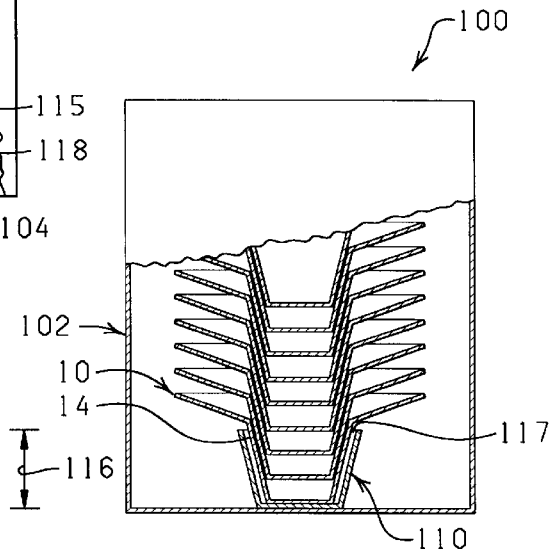
FIG. 7 is a partial cross-sectional view of the shipping apparatus of FIG. 6 taken along line 7—7 thereof.

Referring now to FIG. 7, a cross-sectional view of the shipping apparatus 100 of FIG. 6 taken along line 7—7 thereof is shown. It is readily apparent that the frusto-conical shape of the stacking shell 110 is well suited to substantially conform to the contours of the base 14 of the preformed flower pot cover 10. Additionally, the height 116 of the stacking shell 110 is best suited to support the base 14 of the preformed flower pot cover 10 when the height 116 of the stacking shell 110 is at least sufficient to support the base 14 of the preformed flower pot cover 10. This construction provides for optimal support of the overlapping folds 28 of the preformed flower pot covers 10 disposed within the opening 117 of the stacking shell 110 while preventing damage to the decorative skirt 22 of the preformed flower pot cover 10.

Figure 8:
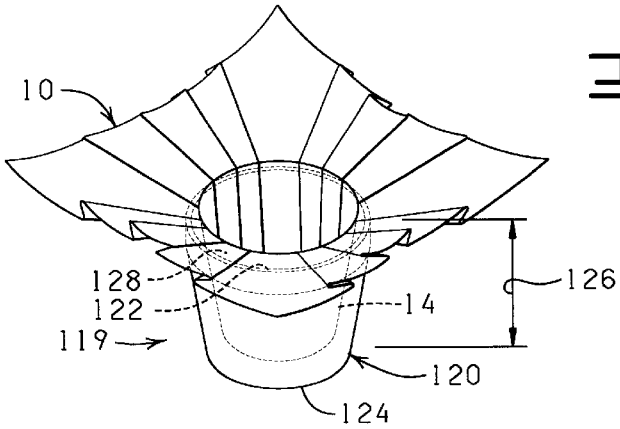
FIG. 8 is a perspective view of another embodiment of a stacking shell of the shipping apparatus constructed in accordance with the present invention.

Referring now to FIG. 8, a side elevational view of another embodiment of a stacking shell 119 for supporting a plurality of preformed flower pot covers 10 in a container, such as the container 102, hereinbefore described, is shown. In this embodiment the stacking shell 119 is a flower pot 120 having an upper end 122, a lower end 124, and a height 126 extending from the upper end 122 to the lower end 124. The flower pot 120 has an opening 128 extending from the upper end 122 to the lower end 124. The optimal size of the flower pot 120 is such that the height 126 of the flower pot 120 measures at least half, but more preferably, is substantially the same height 29 of the base 14 of the preformed flower pot cover 10 (shown above in FIG. 1).

Additionally, the opening 128 of the flower pot 120 should be configured so as to substantially conform to the configuration of the base 14 of the preformed flower pot cover 10. When the flower pot 120 is used as the stacking shell 119 it is attached to the interior surface 112 of the bottom 104 of the container 102 (see FIG. 6) in any manner suitable, as previously described.

The advantages to employing the flower pot 120 as the stacking shell 119 are numerous. For example, as previously mentioned the flower pot 120 may be reused by the receiver of the plurality of preformed flower pot covers 10, the reduction of waste, as well as, a reduction in the cost for otherwise manufacturing the stacking shells 110 (see FIG. 6). The flower pot 120 may be constructed of any material suitable for retaining the preformed flower pot covers 10 disposed in the shipping apparatus 100 so long as the opening 128 of the flower pot 120 provides suitable lateral support for the plurality of overlapping folds 28 of the base 14 of the preformed flower pot cover 10.

Figure 9:
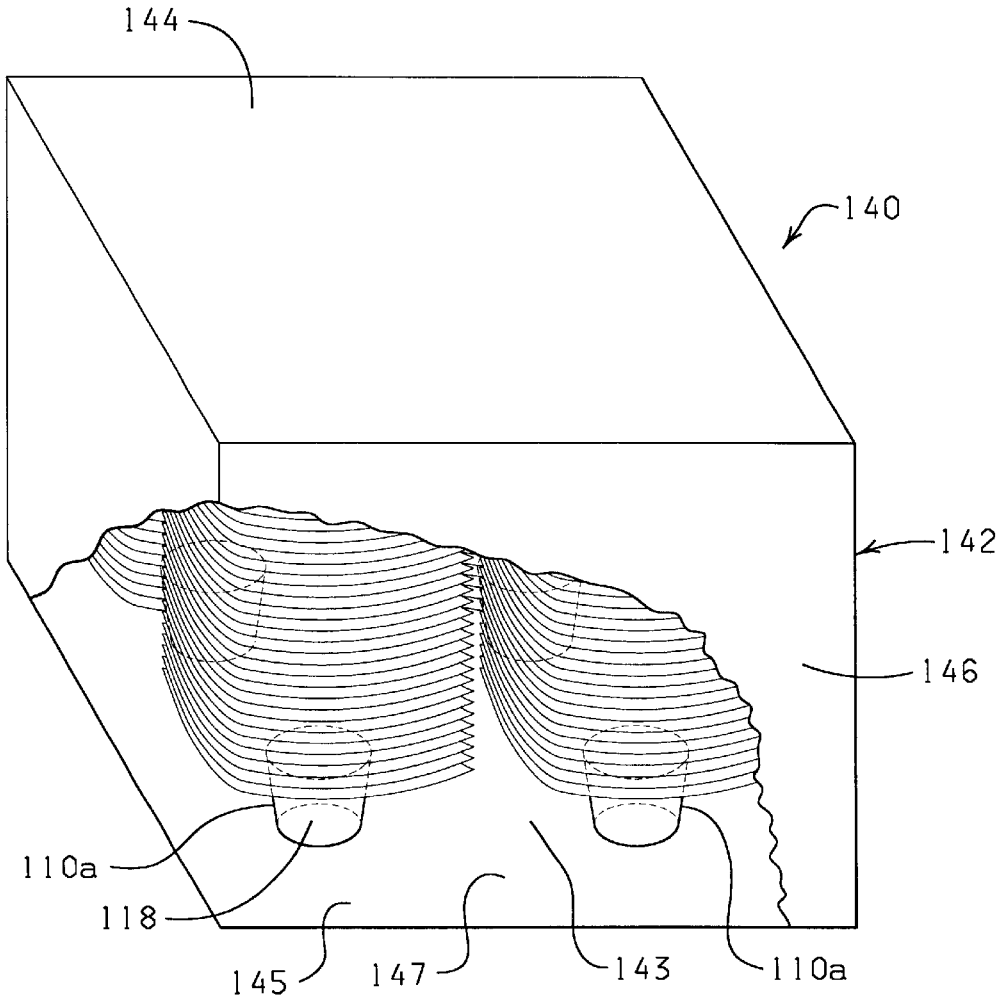
FIG. 9 is a partially cutaway perspective view of another embodiment of a shipping apparatus illustrating the use of a plurality of stacking shells with a plurality of stacks of preformed flower pot covers supported thereon.

Referring now to FIG. 9, a perspective view of another embodiment of the shipping apparatus 140 is shown employing a plurality of stacking shells 110*a*, each of which is similar in construction and function to the stacking shell 110 hereinbefore described with reference to FIGS. 6 and 7. The shipping apparatus 140 is provided with a container 142 which is constructed substantially similar to the container 102 (see FIG. 6) except that the container 142 is larger so as to accommodate the plurality of stacking shells 110*a*. The container 142 is provided with a top 144, a bottom 145 and a plurality of sidewalls 146, only one sidewall 146 being denoted for sake of brevity while cooperating to define a inner packing compartment 143 of the container 142.

In the present embodiment the plurality of stacking shells 110*a* are disposed on an interior surface 147 of the bottom 145 of the container 142. Although four stacking shells 110*a* are depicted, any number of stacking shells 110*a* may be employed to provide for an optimum number of stacks of preformed flower pot covers 10. The number of stacking shells 110*a* is determined by the size of the preformed flower pot covers 10 to be shipped, as well as, the size of the container 142 of the shipping apparatus 140.

It is readily apparent that providing a plurality of stacking shells 110*a* is a more efficient use of shipping space when it is necessary to ship a plurality of stacks of preformed flower pot covers 10. In this manner, the stacking shells 110*a* are configured to substantially conform to the contours of the base 14 of the preformed flower pot covers 10. Thus, the preformed flower pot covers 10 are laterally supported by the exterior base support member 118 of the stacking shell 110*a* so as to prevent the overlapping connecting folds 28 of the preformed flower pot covers 10 from becoming unconnected and to prevent distortion or crushing of the base 14 and decorative skirt 22 of the preformed flower pot cover 10. Thus, the embodiment of the invention depicted in FIG. 9 is well suited to carry out the objectives of the invention of shipping a plurality of stacks of preformed flower pot covers 10 securely and efficiently.

Figure 10:
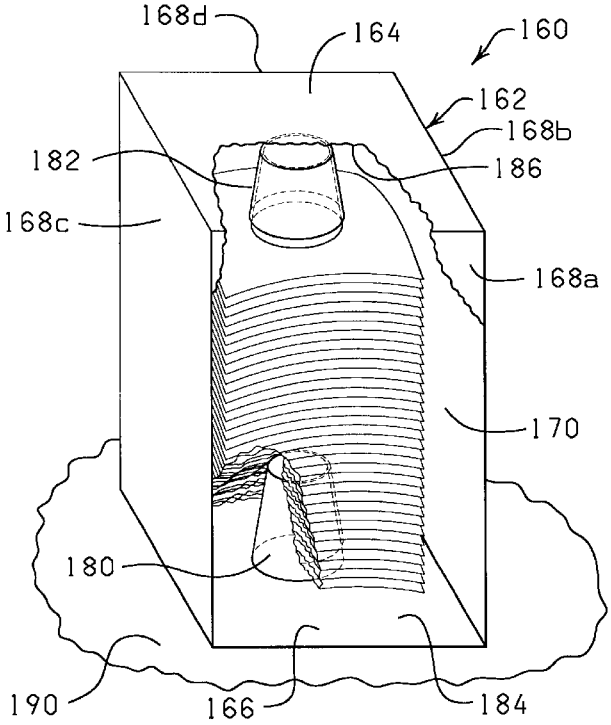
FIG. 10 is a partially cutaway perspective view of another embodiment of a shipping apparatus constructed in accordance with the invention depicting oppositely disposed stacking shells for use in transporting a plurality of preformed flower pot covers.

Referring now to FIG. 10, a perspective view of another embodiment of a shipping apparatus 160 is shown. The shipping apparatus 160 is provided with a container 162. The container 162 is constructed substantially similar to the container 52 (see FIG. 2). The container has a top 164, a bottom 166, and a plurality of sidewalls 168, each of the sidewalls 168 are substantially similar in construction and operation have been alphanumerically denoted 168*a*, 168*b*, 168*c*, and 168*d*, for the sake of clarity. The top 164, the bottom 166, and the plurality of sidewalls 168 cooperate to define an inner packing compartment 170. The shipping apparatus 160 further includes a first stacking shell 180 and a second stacking shell 182.

The first stacking shell 180 is disposed on an interior surface 184 of the bottom 166 of the container 162 and extends upwardly within the inner packing compartment 170. The first stacking shell 180 is constructed substantially similar to the stacking shell 66 (see FIG. 2). In such construction, the first stacking shell 180 is configured to be disposed within the object opening 20 of the base 14 of the preformed flower pot cover 10 and substantially conform to the contours thereof. The preformed flower pot covers 10 are thereby supported on the first stacking shell 180 so that the decorative skirt 22 of the preformed flower pot cover 10 is in a non-load bearing relationship with respect to the interior surface 184 of the bottom 166 of the container 162 so as to prevent crushing, damage and distortion to the base 14 and the decorative skirt 22 of the preformed flower pot cover 10.

The second stacking shell 182 is constructed substantially similar to the stacking shell 110 (see FIG. 6). The second stacking shell 182 is disposed on an interior surface 186 of the top 164 of the container 162 and extends within the inner packing compartment 170 of the container 162. The second stacking shell 182 is adapted to receive the base 14 of the preformed flower pot cover 10 and substantially conform to an opening in the second stacking shell 182.

However, when the second stacking shell 182 is disposed above the first stacking shell 180, as depicted in FIG. 10, relative to a hardened surface 190, the second stacking shell 182 acts only to retain the stack of preformed flower pot covers 10 centrally disposed about the top 164 of the container 162. In this manner, the second stacking shell 182 aids in retaining the stack of preformed flower pot covers 10 within the inner packing compartment 170 such that none of the decorative skirts 22 of the preformed flower pot cover 10 are in contact with the plurality of sidewalls 168 and to further stabilize the stack of preformed flower pot covers 10 within the inner packing compartment 170 of the container 162.

Figure 11:
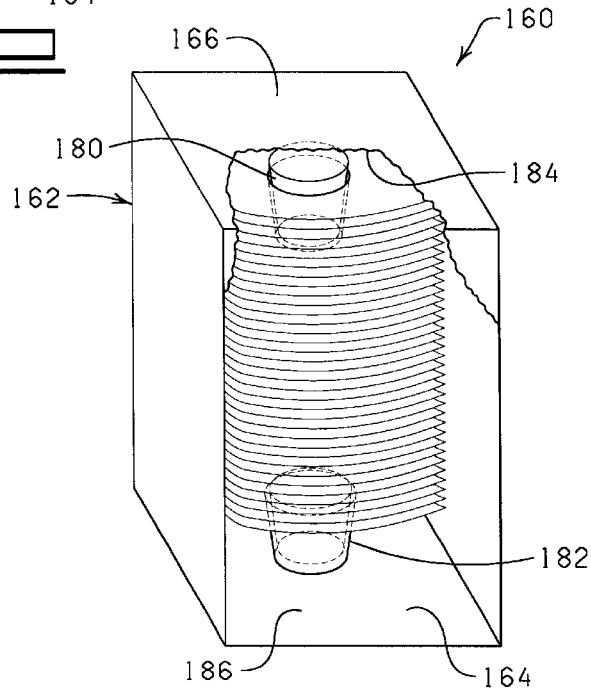
FIG. 11 is a partially cutaway perspective view of the shipping apparatus depicted in FIG. 10 shown in an inverted position.

Additionally, this unique configuration continues to provide such protection and support for the entirety of the stack of preformed flower pot covers 10 even when the shipping apparatus 160 becomes inverted during shipping, as shown in FIG. 11. Thus, the inverted disposition of the shipping apparatus 160 does not effect the protection and support provided to the preformed flower pot covers 10 by the first stacking shell 180 and second stacking shell 182.

In this manner, the top 164 of the container 162 is adjacent the hardened surface 190 and the weight of the stack of preformed flower pot covers 10 rests upon the second stacking shell 182. The second stacking shell 182 provides lateral support for the base 14 of the preformed flower pot covers 10 so as to prevent the overlapping connecting folds 28 of the preformed flower pot covers 10 from becoming unconnected and prevents crushing or distortion to the base 14 of the decorative skirt 22 of the preformed flower pot covers 10.

For this reason, the first stacking shell 180 acts only to retain the stack of preformed flower pot covers 10 centrally disposed about the bottom 166, now inverted, of the container 162. In this manner, the first stacking shell 180 aids in retaining the stack of preformed flower pot covers 10 within the inner packing compartment 170 such that none of the decorative skirts 22 of the preformed flower pot cover 10 are in contact with the plurality of sidewalls 168.

The advantage of this configuration is readily apparent since shipping containers frequently become inverted during the shipping process which causes the contents, in this instance the preformed flower pot covers 10, to become dislodged within their respective shipping devices. Although only a first stacking shell 180 is shown oppositely disposed a second stacking shell 182 it should be understood that a plurality of first stacking shells 180 oppositely disposed a plurality of second stacking shells 182 may be employed without departing from the spirit and scope of the present invention.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A method for shipping a plurality of preformed flower pot covers, each preformed flower pot cover sized to receive a flower pot, the method comprising:

providing a container having a top, a bottom, and a plurality of sidewalls cooperating to define an inner packing compartment;

providing at least one stacking shell attached to the container with a bonding material the bonding material selected from a group of bonding material consisting of via adhesive, a cohesive, double sealed tape and combinations thereof, the at least one stacking shell extending inwardly into the inner packing compartment of the container, the stacking shell adapted to support the preformed flower pot covers within the inner packing compartment of the container; and forming a stack of preformed flower pot covers on the at least one stacking shell such that the preformed flower pot covers are supported by at least one stacking shell; and transporting the container to a predetermined destination.

2. The method of claim 1 wherein the at least one stacking shell is a flower pot having a closed lower end, an open upper end and a base support member between the lower and upper ends.

3. The method of claim 1 wherein each of the preformed flower pot covers is further provided with a base and a decorative skirt extending from the base of the preformed flower pot cover and wherein the at least one stacking shell is defined as having an interior base support member such that upon providing a stack of preformed flower pot covers, the preformed flower pot covers are supported on the at least one stacking shell so that the decorative skirt is in a non-load bearing relationship so as to prevent damage to the decorative skirt.

4. The method of claim 3 wherein the preformed flower pot cover is further defined as having a height extending from a lower end of the base to the decorative skirt of the preformed flower pot cover and wherein the interior base support member of the at least one stacking shell is further defined as having a height extending from a lower end to an upper end of the interior base support member of the at least one stacking shell, the height of the preformed flower pot cover measuring less than the height of the interior base support member of the at least one stacking shell.

5. The method of claim 4 wherein the at least one stacking shell is a flower pot having a closed lower end, an open upper end and base support member between the lower and upper ends.

6. An apparatus for shipping a plurality of preformed flower pot covers, comprising:

a container having a top, a bottom, and a plurality of sidewalls cooperating to define an inner packing compartment;

at least one first stacking shell configured so as to correspondingly receive the preformed flower pot covers attached to the container and extending inwardly into the inner packing compartment; and at least one second stacking shell attached to the container extending inwardly into the inner packing compartment comprising a flower pot having a closed lower end, an open upper end and an interior base support member extending between the closed lower end and the open upper end of the flower pot, the interior base support member of the flower pot configured to conform to the contour of the preformed flower pot covers such that the flower pot is disposable into one of the preformed flower pot covers.

* * * * *

UNITED STATES PATENT AND TRADEMARK OFFICE

CERTIFICATE OF CORRECTION

PATENT NO. : 6,675,968 B2
APPLICATION NO. : 10/131722
DATED : January 13, 2004
INVENTOR(S) : Frank J. Craig et al.

It is certified that error appears in the above-identified patent and that said Letters Patent is hereby corrected as shown below:

Column 3, line 62: After the words "about the" delete the word "all" at the end of the line.

Signed and Sealed this

Twenty-seventh Day of February, 2007

JON W. DUDAS
*Director of the United States Patent and Trademark Office*